US005628802A

United States Patent [19]

Karol et al.

[11] Patent Number: 5,628,802

[45] Date of Patent: May 13, 1997

[54] FUEL COMPOSITIONS CONTAINING ORGANIC MOLYBDENUM COMPLEXES

[75] Inventors: Thomas J. Karol, Norwalk; Steven G. Donnelly, New Fairfield, both of Conn.

[73] Assignee: R. T. Vanderbilt Company, Inc., Norwalk, Conn.

[21] Appl. No.: 451,291

[22] Filed: May 26, 1995

[51] Int. Cl.[6] ..... C10L 1/30

[52] U.S. Cl. ..... 44/367

[58] Field of Search ..... 44/358, 367

[56] References Cited

U.S. PATENT DOCUMENTS 4,164,473 8/1979 Coupland ..... 44/367

4,889,647 12/1989 Rowan et al. .

5,137,647 8/1992 Karol .

5,412,130 5/1995 Karol ..... 556/57

*Primary Examiner*—Prince Willis, Jr.

*Assistant Examiner*—Cephia D. Toomer

*Attorney, Agent, or Firm*—Rasma B. Balodis

[57] ABSTRACT

Oxidative stability of petroleum motor fuel is improved by adding to the fuel an effective amount of heterocyclic molybdenum complex prepared by reacting (a) diol, amino or amino-alcohol compound and (b) a molybdenum source sufficient to yield about 2.0 to 20.0 percent of molybdenum based on the weight of the complex.

8 Claims, No Drawings

FUEL COMPOSITIONS CONTAINING ORGANIC MOLYBDENUM COMPLEXES

BACKGROUND OF THE INVENTION

The present invention concerns improved petroleum fuel compositions. More particularly, it relates to gasoline and diesel fuel compositions having improved stability.

Petroleum motor fuels for internal combustion engines, particularly gasoline for spark ignition engines and diesel fuel for compression engines, are susceptible to formation of insoluble tars or gums upon exposure to atmospheric oxygen. During storage, gum formation is particularly severe in fuels derived from catalytic refining processes. Gum formation in gasoline is the result of oxidation and polymerization of unsaturated components, particularly dienes or highly unsaturated compounds, the resulting product being resinous gums. Similarly, diesel fuels form gums during storage. Some types of gums are soluble in the fuel and a residue is formed after the fuel has been evaporated. Thus, a buildup of gum can form on the fuel injection system. Moreover, insoluble solid particles can form when stocks containing dissolved gums are blended together. The particles can clog fuel filters and injection systems. When motor fuels are stored for any considerable period, an additive to inhibit oxidative gum formation is incorporated into the fuel.

It has been discovered that petroleum fuels, particularly motor fuels normally susceptible to oxidative gum formation, can be stabilized by incorporating certain organic heterocyclic molybdenum complexes. Molybdenum compounds are widely used in lubricants, but hereto have not been known to provide protection against gum formation in fuels for internal combustion engines.

SUMMARY OF THE INVENTION

In accordance with the invention, there are provided stabilized motor fuel compositions comprising a major portion of a petroleum fuel selected from gasoline and diesel fuel and a minor amount effective to inhibit oxidative gum formation, of a heterocyclic molybdenum complex prepared by reacting (a) diol, diamino, or amino-alcohol compound and (b) a molybdenum source sufficient to yield about 2.0 to 20.0 percent of molybdenum based on the weight of the complex and having a major component of the formula

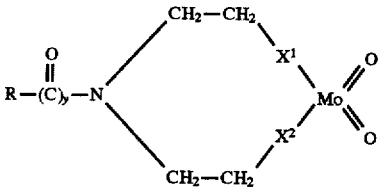

wherein $X^1$ and $X^2$ are independently selected from O and HN groups, y=0–1 and R is alkyl, alkyl with pendant or internal oxygen and fatty acid residue having a total of 8 to 22 carbon atoms.

DETAILED DESCRIPTION OF THE INVENTION

The heterocyclic molybdenum complexes are reaction products that are phosphorus and sulfur free. The complexes can be prepared by several known methods.

U.S. Pat. No. 5,412,130 discloses a process for preparing heterocyclic molybdates by reacting diol, diamino or aminoalcohols of formula (I) or (II) with a molybdenum source and in the presence of a phase transfer agent.

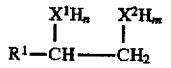

(I)

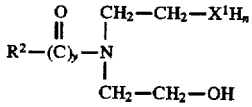

(II)

wherein $X^1$ and $X^2$ represent O or N; n or m=1 when $X^1$ or $X^2$ is O and n or m=2 when $X^1$ or $X^2$ is N; y=0 or 1; $R^1$ and $R^2$ represent alkyl having 8 to 22 carbon atoms and alkyl having pendant or internal oxygen. Exemplary groups include, among others, hydroxyethyl, alkoxy and carboxyalkyl groups.

The phase transfer agent is of the formula (III)

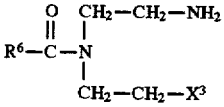

(III)

wherein $R^6$ is an alkyl group or fatty acid residue having a total of 8 to 22 carbon atoms and $X^3$ is a hydroxy or amino group.

The source of molybdenum is an oxygen-containing molybdenum compound capable of reacting with the transfer agent to form an ester type molybdenum complex. The sources of molybdenum include, among others, ammonium molybdates, molybdenum oxides and mixtures thereof. The molybdenum source is added in a sufficient quantity to yield about 2.0 to 20 percent, preferably 6.0 to 12.0 percent of molybdenum based on the product.

When the transfer agent is added to the receptor molecule of the formula (I) and (II), molybdenum is transferred from the transfer complex to the receptor molecule to form a heteroatom substituted molybdenum compound of the formula (IV) or (V).

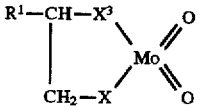

(IV)

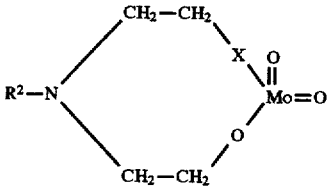

(V)

wherein $R^1$ and $R^2$ is alkyl or alkyl with a pendant or internal oxygen, fatty acid, or oil radical having a total of 8 to 22 carbon atoms, X and $X^3$ is O or HN group.

Other molybdenum complexes that are useful to the practice of the invention are reaction products of a fatty oil, diethanolamine and a molybdenum source and prepared by a method described in U.S. Pat. No. 4,889,647. It is believed that the major components are of the structural formula (VI) and (VII).

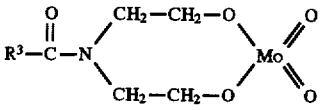

(VI)

-continued

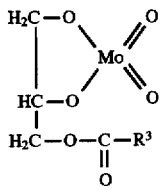

(VII)

wherein $R^3$ represents a fatty acid residue having a total of up to 22 carbon atoms. The molybdenum source defined hereinabove is added in a sufficient quantity to yield 0.5 to 10.0 percent of molybdenum per reaction product.

Another heterocyclic molybdenum complex of the invention is the reaction product of a fatty derivative of 2-(2-aminoethyl)aminoethanol and a molybdenum source and prepared by a method described in U.S. Pat. No. 5,137,647. It is believed that the major components have the structural formula (VIII) and (IX).

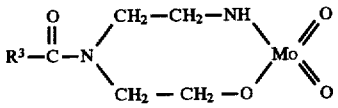

(VIII)

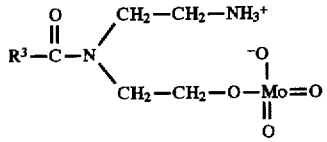

(IX)

wherein $R^3$ represents a fatty acid residue.

The fatty acids may be saturated or unsaturated. Particularly useful are lauric, palmitic, stearic, oleic, linolenic and linoleic acids. Preferred are fatty residues containing at least a total of 8 carbon atoms and may contain 22 carbon atoms and higher and preferably a total of 12 carbons and higher.

The source of molybdenum is an oxygen-containing compound capable of reacting with the fatty acid derivative of 2-(2-aminoethyl)aminoethanol to form an ester-type molybdenum complex.

The molybdenum complexes of the invention are particularly useful for stabilization of normally liquid fuel compositions that are light petroleum distillates. Among such fuels are motor fuels for internal combustion engines commonly known as gasoline and diesel fuels. These fuels are produced by various processes such as fractional distillation, pyrolytic cracking, catalytic cracking and catalytic reforming. Olefinic gasoline blends are produced by polymerization processes. A process referred to as dimerization produces gasoline referred to as "dimate" gasoline. The petroleum based fuels are complex mixtures of hydrocarbons containing straight and branched chain paraffins, cycloparaffins, olefins, aromatic hydrocarbons and acidic contaminants. The properties of these fuels are well known to those skilled in the art. The light petroleum distillates having a boiling point ranging from 37° to 205° C. are used in gasoline. Diesel fuel consists of petroleum distillates having a boiling point ranging from 163° to 400° C. Specifications are established by the American Society for Testing Materials by ASTM Specification D 396-80 for fuel oils and D439-79 for gasoline.

Regardless of the method of production, motor fuels generally suffer from oxidative degradation during storage. The molybdenum complexes of the invention are particularly effective against gum formation and prevention of deposits that adversely affect combustion performance. Depending on the type of fuel, an effective amount is 7 ppm to 8000 ppm of the inhibitor and preferably 175 ppm to 4000 ppm based on the fuel composition.

The fuel compositions may contain other additives generally employed in the industry: antiknock agents, rust inhibitors, metal deactivators, upper cylinder lubricants, detergents, dispersants, and other antioxidants of the phenylenediamine, aminophenol and hindered phenol type.

Fuel stability in actual storage depends on various factors such as composition, exposure to oxygen and storage temperature. Tests for predicting gum formation during storage were conducted as described below. All percentages given herein are by weight unless otherwise indicated.

EXAMPLE 1

The stability of gasoline was determined by the oxidation stability test conducted according to ASTM Method D-525. The sample was oxidized in a bomb filled with oxygen at 100 psi and 98° to 102° C. The pressure was recorded until the break point was reached in the pressure-time curve. The time required for the sample to reach this point is the observed induction period which is an indication of the tendency to form gum during storage.

The results are compiled in Table I. Sample A contained untreated gasoline with no stabilizer, while Sample B contained reaction product of coconut oil, 2,2'-iminobisethanol and molybdenum trioxide having a molybdenum content of 8.1 percent. Sample B indicated good storage stability.

TABLE I

| Sample | Additive, ppm | Induction Period |
|---|---|---|
| A | — | 8 hrs., 45 mins. |
| B | 840 | 17 hrs. |

EXAMPLE 2

The stability of Diesel Fuel No. 2 was determined by the oxidation stability test according to the ASTM D2274 method. A measured volume of filtered fuel oil was aged at 95° C. while oxygen was bubbled continuously through the sample. After aging for 16 hours, the total amount of insoluble material formed was determined.

Sample C contained fuel oil without additives and Sample D contained fuel oil and molybdenum additive described in Example I. Sample D showed good stability as demonstrated by Data compiled in Table II.

TABLE II

| | Diesel Fuel Additive, | | Filterable | Adherent | Total |
|---|---|---|---|---|---|
| Sample | No. 2, Parts | Parts | Insol., mg/100 ml | Insol., mg/100 ml | Insol., mg/100 ml |
| C | 100.000 | — | 1.97 | 2.03 | 4.00 |
| D | 99.933 | 0.067 | 0.60 | 0.97 | 1.57 |

The additives of the invention furthermore impart wear resistance to the fuel oils, thus improving the power, economy, performance and wear of the engine. The improved wear of fuel oil containing the molybdenum additives of the invention is demonstrated in Example 3.

EXAMPLE 3

The additives of the invention were evaluated by the Four-Ball Wear Test according to the ASTM D 4172 procedure. Four lightly polished steel balls 12.5 mm in diameter were placed in a test cup and submerged in a test sample. The test fuel was Diesel Fuel Oil No. 2. The test was carried out at a rotation speed of 1800 rpm under a load of 20 kg for one hour at 93.3° C.

The additive of the invention described in Example 1 was added to the fuel oil in the amount indicated in Table III. Fuel compositions containing the present additives show improved antiwear properties.

TABLE III

| Four-Ball Wear Test in Fuel Oil No. 2 | | | |
|---|---|---|---|
| Sample | Active Ingredient | Percent | Scar, mm |
| E | None | — | 0.77 |
| F | Compound of Example 1 | 0.067 | 0.36 |
| G | Compound of Example 1 | 0.1 | 0.33 |
| H | Compound of Example 1 | 0.5 | 0.40 |

The above embodiments have shown various aspects of the present invention. Other variations will be evident to those skilled in the art and such modifications are intended to be within the scope of the invention as defined by the appended claims.

What is claimed is:

1. A stabilized motor fuel composition comprising a major portion of a petroleum fuel selected from gasoline and diesel fuel and a minor amount effective to inhibit oxidative gum formation, of a heterocyclic molybdenum complex prepared by reacting (a) diol, diamino, or amino-alcohol compound and (b) a molybdenum source sufficient to yield about 2.0 to 20.0 percent of molybdenum based on the weight of the complex and having a major component of the formula (I) and (V)

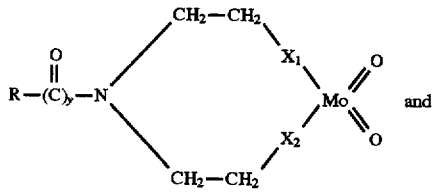

(I)

and

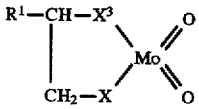

(V)

wherein X, $X^1$, $X^2$ and $X^3$ are independently selected from O and HN groups, y=1 and R and $R^1$ are independently selected from alkyl, alkyl with pendant oxygen substituent group, alkyl having internal oxygen substituent, or fatty acid residue having a total of 8 to 22 carbon atoms.

2. A stabilized fuel composition according to claim 1 wherein the molybdenum complex is present in the amount of 7 ppm to 8000 ppm based on the fuel composition.

3. A stabilized motor fuel composition comprising a major portion of a petroleum fuel selected from gasoline and diesel fuel and a minor amount effective to inhibit oxidative gum formation, of a heterocyclic molybdenum complex prepared by reacting (a) diol, diamino, or amino-alcohol compound of formula (II) or (III)

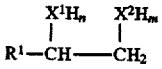

(II)

-continued

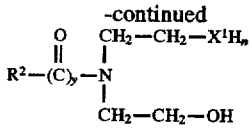

(III)

wherein $X^1$ and $X^2$ represent O or N; n or m=1 when $X^1$ or $X^2$ is O and n or m=2 when $X^1$ or $X^2$ is N; y=1; $R^1$ and $R^2$ are independently selected from alkyl having 8 to 22 carbon atoms, alkyl having pendant oxygen a fatty acid residue having a total of 8 to 22 carbon atoms and (b) a molybdenum source sufficient to yield about 2.0 to 20.0 percent of molybdenum based on the weight of the complex in the presence of a transfer agent of formula IV

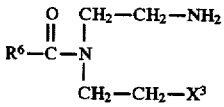

(IV)

wherein $R^6$ is an alkyl group or fatty acid residue having a total of 8 to 22 carbon atoms and $X^3$ is a hydroxy or amino group and wherein the molybdenum complex has the structural formula (V) or (VI)

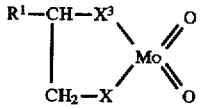

(V)

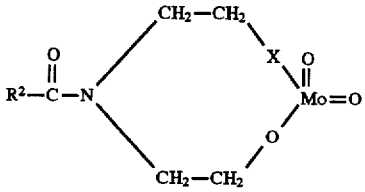

(VI)

wherein $R^1$ and $R^2$ are independently selected from alkyl, alkyl with a pendant oxygen substituent group, alkyl having internal oxygen or fatty acid or oil radical having a total of 8 to 22 carbon atoms, X and $X^3$ is O or HN group.

4. A composition according to claim 3 wherein the reaction product is prepared by using a molybdenum source selected from molybdenum oxides and ammonium molybdates.

5. A composition according to claim 3 wherein the molybdenum complex has a structural formula of V or VI wherein $R^1$ and $R^2$ is a coconut oil residue.

6. A stabilized motor fuel composition comprising a major portion of a petroleum fuel selected from gasoline and diesel fuel and a minor amount effective to inhibit oxidative gum formation, of a heterocyclic molybdenum complex prepared by reacting (a) a fatty oil, (b) diethanolamine and (c) a molybdenum source sufficient to yield about 0.5 to 10.0 percent of molybdenum based on the weight of the complex and having a major component of the formula (VII) and (VIII)

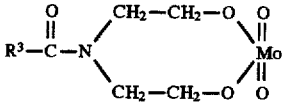

(VII)

-continued

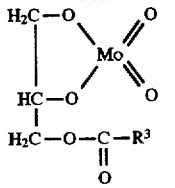

(VIII)

wherein $R^3$ represents a fatty acid residue having a total of 22 carbon atoms.

7. A stabilized motor fuel composition comprising a major portion of a petroleum fuel selected from gasoline and diesel fuel and a minor amount effective to inhibit oxidative gum formation, of a heterocyclic molybdenum complex prepared by reacting (a) a fatty derivative of 2-(2-aminoethyl) aminoethanol and (b) a molybdenum source sufficient to yield about 2.0 to 20.0 percent of molybdenum based on the weight of the complex and having a major component of the formula (IX) and (X)

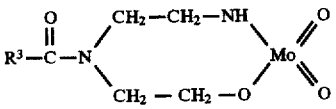

(IX)

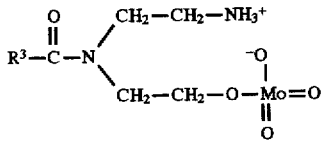

(X)

wherein $R^3$ represents a fatty acid residue having a total of 8 to 22 carbon atoms.

8. A method of stabilizing petroleum motor fuel comprising adding to said fuel composition 7 ppm to 8000 ppm of a heterocyclic molybdenum complex prepared by reacting (a) diol, diamino or amino-alcohol compound and a molybdenum source sufficient to yield about 2.0 to 20.0 percent by weight of molybdenum based on the weight of the complex and having a major component of the formula (I) and (V).

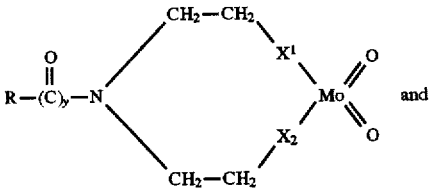

(I)

and

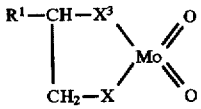

(V)

wherein X, $X^1$, $X^2$ and $X^3$ are independently selected from O and HN groups, y=1 and R and $R^1$ are independently selected from alkyl, alkyl with pendant oxygen substituent group, alkyl having internal oxygen substituent, or fatty acid residue having a total of 8 to 22 carbon atoms.

* * * * *

UNITED STATES PATENT AND TRADEMARK OFFICE

CERTIFICATE OF CORRECTION

PATENT NO. : 5,628,802

DATED : May 13, 1997

INVENTOR(S) : Thomas J. Karol and Steven G. Donnelly

It is certified that error appears in the above-identified patent and that said Letters Patent is hereby corrected as shown below:

At column 6, line 10
"pendant oxygen a fatty acid" should read

--pendant oxygen substituent group, alkyl having internal oxygen or a fatty acid--.

Signed and Sealed this

Twenty-second Day of July, 1997

Bruce Lehman

*Attest:*

BRUCE LEHMAN

*Attesting Officer*

*Commissioner of Patents and Trademarks*